US005526557A

United States Patent [19]

Dalla Vecchia

[11] Patent Number: 5,526,557

[45] Date of Patent: Jun. 18, 1996

[54] TEASELING AND/OR FLUFFING MACHINE FOR FABRIC AND KNITWORK WITH IMPROVED SUCTION AND CLEANING

[75] Inventor: Gino Dalla Vecchia, Santorso, Italy

[73] Assignee: Sperotto Rimar S.p.A., Thiene, Italy

[21] Appl. No.: 291,458

[22] Filed: Aug. 17, 1994

[30] Foreign Application Priority Data

Aug. 30, 1993 [IT] Italy ..... MI93A1862

[51] Int. Cl.[6] ..... D06C 11/00

[52] U.S. Cl. ..... 26/29 P; 26/33

[58] Field of Search ..... 26/29 R, 31, 32, 26/33, 34, 35, 29 P, 27, 28

[56] References Cited

U.S. PATENT DOCUMENTS

| | | | |
|---|---|---|---|
| 647,323 | 4/1900 | O'Brien | 26/29 P |
| 1,154,350 | 9/1915 | Thiel | 26/33 |
| 1,742,829 | 1/1930 | Schreiber | 26/29 P |
| 1,746,798 | 2/1930 | Schramm et al. | 26/29 P |
| 2,128,366 | 8/1938 | Knowlton | 26/29 P |

FOREIGN PATENT DOCUMENTS

| | | | |
|---|---|---|---|
| 40355 | 8/1909 | Austria | 26/29 P |
| 3014595 | 10/1981 | Germany | 26/29 P |
| 213249 | 9/1984 | Germany | 26/29 P |
| 26566 | 2/1984 | Japan | 26/29 P |
| 1193588 | 6/1970 | United Kingdom | 26/29 P |

*Primary Examiner*—Amy B. Vanatta
*Attorney, Agent, or Firm*—Cushman Darby & Cushman

[57] ABSTRACT

A teaseling and/or fluffing machine for fabric and knitwork with improved suction and cleaning, including a load-bearing structure with two sidepieces supporting at least one drum which rotates about a central shaft and supports on its two lateral endpieces two series of teaseling and/or fluffing rollers of with-pile type and against-pile-type, arranged along the generatrices of the drum with those of one series rotating relative to those of the other under independent drive. A fabric to be treated passes about the teaseling and/or fluffing rollers and is fed to the machine by a driven feed roller and extracted therefrom by a driven exit roller. Brushes are provided which interact alternately with the teaseling and/or fluffing rollers. A suction unit associated with apertures provided in a sidepiece of the load-bearing structure creates a suction within the drum to collect the fibers and dust generated during operation. The brushes are specifically divided into two mutually interacting groups of two.

4 Claims, 3 Drawing Sheets

TEASELING AND/OR FLUFFING MACHINE FOR FABRIC AND KNITWORK WITH IMPROVED SUCTION AND CLEANING

BACKGROUND OF THE INVENTION

This invention relates to a teaseling and/or fluffing machine for fabric and knitwork with improved suction and cleaning.

Known teaseling and/or fluffing machines are composed essentially of one or more drums rotating with predetermined direction and speed, along their circumference there being housed a certain number of teaseling and/or fluffing rollers. If the rollers are teaseling rollers they are embraced by cloth carrying needles projecting alternately in the same direction as the fabric (with the pile) and in the opposite direction (against the pile), these rollers rotating about respective longitudinal axes under independent control. The same applies to fluffing rollers, which carry an abrasive paper covering instead of cloth carrying needles. These rollers also rotate with predeterminable speed and direction.

During its operation, the machine produces a considerable quantity of down, filaments and dust some of which deposit between the needles of teaseling machines or on the abrasive paper of fluffing machines, and some of which escape into the environment, especially the dust.

Although no collection system is provided in the machine for the dust which escapes into the environment, there is generally an arrangement consisting of a pair of sector brushes for cleaning the teaseling and/or fluffing elements.

Depending on their type, the sectors are used either for the with-pile rollers or for the against-pile rollers, and operate in phase with the drum during the short passage of the relative teaseling and/or fluffing rollers through the relative brush region.

The filaments or fibres removed from the brushes are then collected via a suction device having an inlet opening positioned below the brushes.

Apart from the need to solve the environmental problem by providing the machine with collection systems suitable for the particular case, it is also necessary to provide the machine with a more efficient brushing system. It should also be noted that teaseling and/or fluffing machines are virtually identical in terms of their layout. They have the drum at the top, the brushes at the bottom and the suction inlet below the brushes.

The reason for this layout is to enable the fibres and filaments to fall downwards by gravity in order to improve cleaning.

However it has proved not to be so in reality because the air movement deriving from the rotation of the drum and the teaseling and/or fluffing rollers and the movement of the fabric means that the brushing and suction system collects only those fibres deriving from the needles or the abrasive paper of the relative teaseling and/or fluffing rollers.

SUMMARY OF THE INVENTION

The object of the present invention is to solve the aforesaid problems.

This object is attained according to the present invention by a teaseling and/or fluffing machine for fabric and knitwork with improved suction and cleaning, comprising essentially a load-bearing structure consisting of two sidepieces supporting at least one drum which rotates about a central shaft and supports on its two lateral endpieces two series of teaseling and/or fluffing rollers of with-pile and against-pile type, these being arranged along the generatrices of the drum with those of one series rotating relative to those of the other under independent drive, a fabric to be treated passing about the teaseling and/or fluffing rollers and being fed to the machine by a driven feed roller and extracted therefrom by a driven exit roller, there also being provided brushes which interact alternately with the teaseling and/or fluffing rollers, characterised in that a suction unit associated with apertures provided in a sidepiece of the load-bearing structure creates a suction within the drum to collect the fibres and dust generated during operation.

In the machine, the brushes are divided into two groups each comprising a first rotating brush directly interacting alternately with the teaseling and/or fluffing roller of with-pile or against-pile type, and a second rotating brush interacting directly and continuously with the relative first rotating brush, the interaction between the first and second brushes of the two groups being continuous whereas the interaction of the brushes with the teaseling and/or fluffing rollers being selectively intermittent and predetermined on the basis of the type of roller.

BRIEF DESCRIPTION OF THE DRAWINGS

The characteristics and advantages of a teaseling and/or fluffing machine according to the present invention will be more apparent from the ensuing description given by way of non-limiting example with reference to the accompanying schematic drawings, in which.

DETAILED DESCRIPTION

Figure 1:
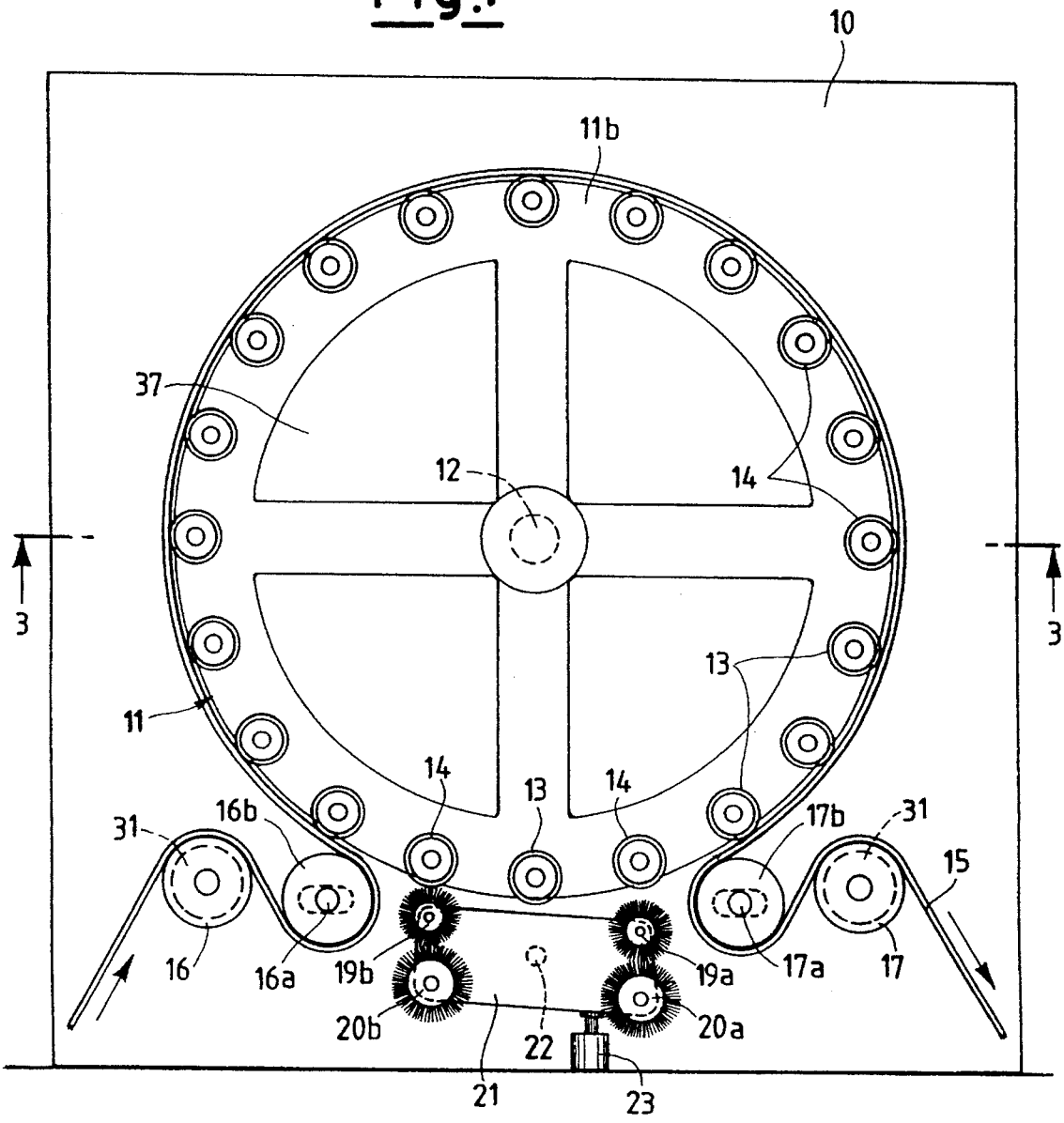
FIG. 1 is a cross-section through the teaseling and/or fluffing machine according to the present invention taken on the line 1—1 of FIG. 2.

The figures show a teaseling and/or fluffing machine for fabric and knitwork with improved suction and cleaning according to the present invention.

The teaseling and/or fluffing machine comprises essentially a load-bearing and containing structure consisting generally of two sidepieces 10, on which there is supported a drum 11 rotating about a central motorized shaft 12. The endpieces 11*a*, 11*b* of the drum 11 support two series of teaseling and/or fluffing rollers, respectively with the pile 13 and against the pile 14, arranged along generators of the drum 11. In addition, the rollers 13 and 14, for example, alternate individually with each other and rotate with independent drive and direction one to the other.

A fabric 15 to be treated passes partially about the drum 11 and over the teaseling and/or fluffing rollers 13 and 14 and is fed by a feed roller 16, but before passing onto the drum and over the teaseling and/or fluffing rollers 13 and 14 to be extracted by an exit roller 17 it passes about and is controlled by further rollers 16*b* and 17*b*.

The feed roller 16 and exit roller 17 are located in proximity to two groups of teaseling and/or fluffing roller cleaning brushes. The first group of said brushes comprises a rotating brush 19*a* alternately interacting directly with a teaseling and/or fluffing roller 13 of with-pile type, and a rotating counter-brush interacting continuously with the rotating brush 19*a*.

Likewise, the second group of brushes comprises a rotating brush 19b alternately interacting directly with a teaseling and/or fluffing roller 14 of against-pile type, and a rotating counter-brush 20b continuously interacting with the rotating brush 19b as shown in FIG. 1.

Both the brush groups are made alternately and selectively active, the first group always on the with-pile teaseling and/or fluffing rollers 13 and the second group always on the against-pile teaseling and/or fluffing rollers 14.

In this respect, for example the plate 21 is pivoted centrally at 22 and supports pivoted at opposing ends the two groups of brushes 19a, 20a and 19b, 20b respectively, it being made to swivel by operating an actuator 23 connected to it and swivel-mounted on the load-bearing structure 10.

The brushing system according to the present invention enables two important objectives to be achieved, namely a greater brushing efficiency and the activation of more teaseling and/or fluffing rollers by the facility for approaching the rollers at the drum entry and exit.

Further according to the invention, axial suction is provided in a teaseling and/or fluffing machine via one of the sidepieces 10.

Figure 2:
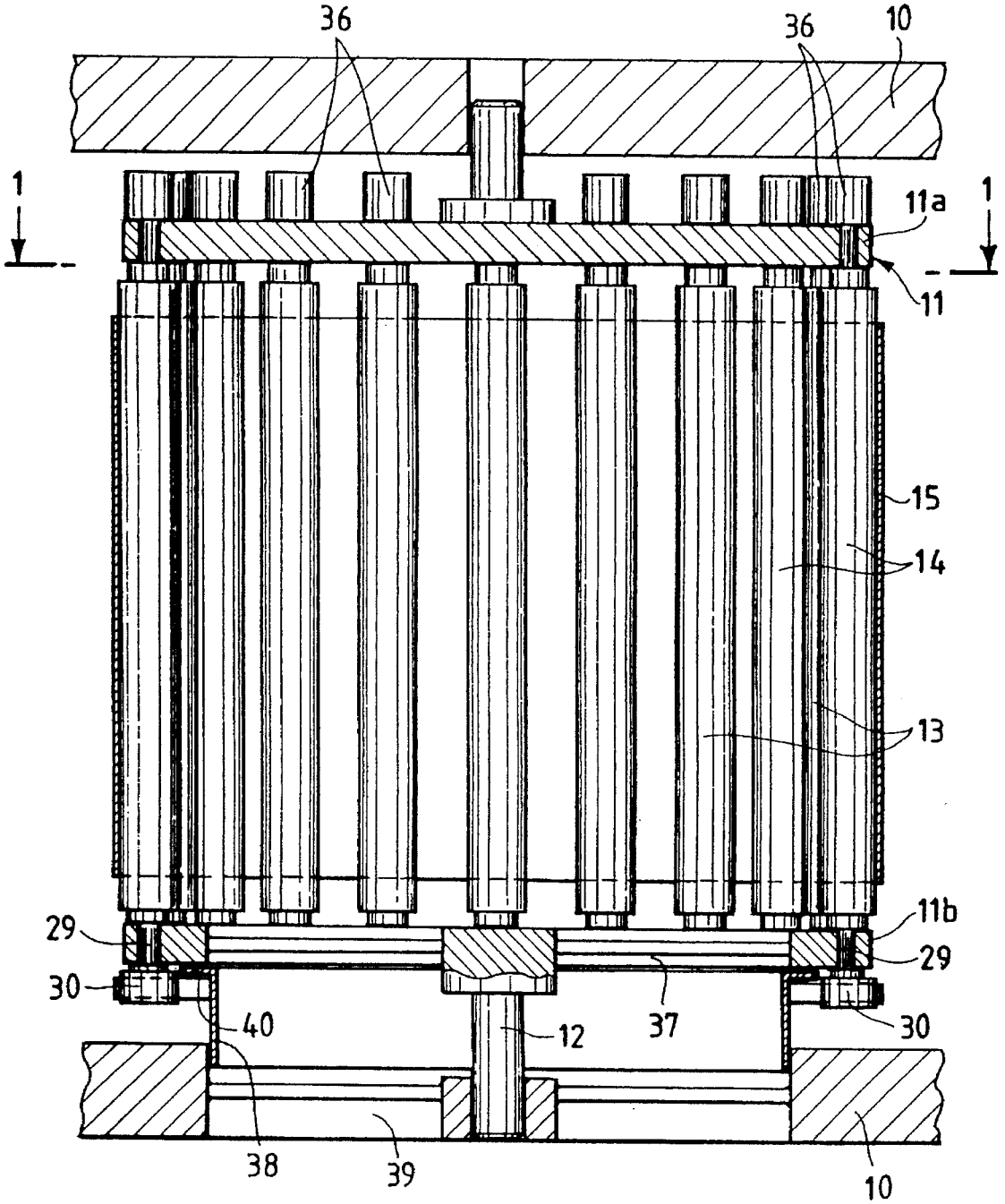
FIG. 2 is a section on the line 2—2 of FIG. 1.

In this manner, a suction is created within the drum 11 to collect the fibres and dust generated during operation, by a suction unit, not shown, associated with apertures 37 provided in a sidepiece 10 of the load-bearing structure, as illustrated in FIG. 2 with regard to the endpiece 11b.

In this region, there is an annular wall 38 connecting the apertures 37 to further apertures 39 provided in the sidepiece 10 to define a header for drawing off the dust produced during operation of the teaseling and/or fluffing rollers 13 and 14, it being connected to a suction unit, not shown.

The seal of the annular wall 38 is further improved by providing flange portions 40 facing the drum supporting the teaseling and/or fluffing rollers 13 and 14.

Figure 3:
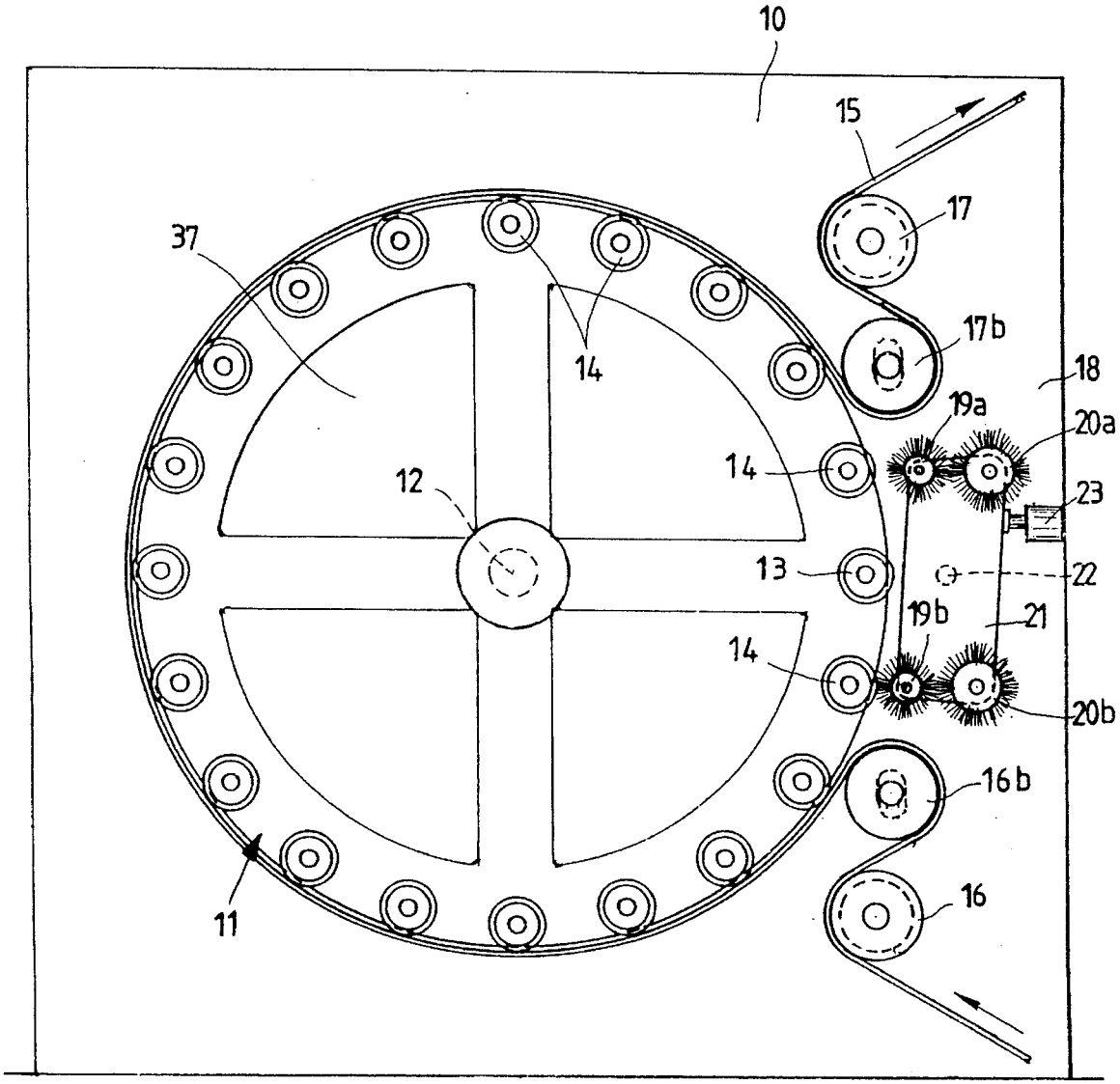
FIG. 3 is a cross-section through a further embodiment of a teaseling and/or fluffing machine according to the invention.

FIG. 3 shows a further embodiment of the machine according to the invention, in which the feed roller 16, the exit roller 17, the further rollers 16b and 17b and the brush groups 19a, 20a and 19b, 20b are positioned in proximity to a vertical lateral wall 18. This achieves a positioning of the brush groups lateral to the drum, thereby considerably reducing machine maintenance and reducing the path of the fabric in passing from a first drum to a second drum in a multiple machine, not shown.

Hence, a teaseling and/or fluffing machine according to the invention has the following advantages:

efficient cleaning of the teaseling and/or fluffing rollers achieved by interposing continuously rotating counter-brushes with the result of making more teaseling and/or fluffing rollers operative, so increasing efficiency;

optimum ecological considerations achieved using systems for collecting the fibres and dust directly at their point of major production, i.e., within the drum.

I claim:

1. A machine for teaseling and/or fluffing pile of a fabric being fed to and extracted from the machine, comprising:

a load-bearing structure comprising two side pieces;

at least one drum having a central shaft supported in said side pieces for rotation of the drum about said shaft, said drum having a circumference defined by a succession of generatrices;

said drum having two axially opposite end pieces which support between them two intercalated series of fabric pile-treating rollers for at least one of teaseling and fluffing the pile, said rollers being arranged along respective generatrices of said drum;

one said series of said rollers having a drive driving them for rotation in a first direction which corresponds to a direction of lay of said pile from said fabric, and the other said series of said rollers having a drive driving them for rotation in a second direction which is opposite to said direction of lay of said pile;

a motor-driven feed roller disposed adjacent said drum at a first location;

a motor-driven exit roller disposed adjacent said drum at a second location which is displaced angularly about said circumference of said drum from said first location, so that the fabric can be fed by contact with said feed roller into contact with said rollers of the said series, about a portion of the circumference of the drum and extracted by contact with said exit roller;

a plurality of cleaning brushes supported adjacent said circumference for cleaning engagement with rollers of said one and other series;

means defining at least one first aperture through at least one of said end pieces of said drum;

means defining at least one second aperture through at least one of said side pieces of said load-bearing structure;

each said first aperture being disposed in spacedly confronting relation to a respective said second aperture;

at least one suction unit having an inlet communicating through a respective said second aperture with a respective said first aperture, for collection by suction from within said drum fibers and dust generated by interaction of said fabric with said machine;

said respective second aperture being circular; and a tubular conduit mounted at one end thereof to a respective said end piece of said drum surrounding a respective said first aperture, and projecting axially outwards into said respective second aperture.

2. The machine of claim 1, wherein:

said one end of tubular conduit is mounted to said respective end piece of said drum by means of a radially projecting annular flange provided on said one end of said tubular conduit.

3. A machine for teaseling and/or fluffing pile of a fabric being fed to and extracted from the machine, comprising:

a load-bearing structure comprising two side pieces;

at least one drum having a central shaft supported in said side pieces for rotation of the drum about said shaft, said drum having a circumference defined by a succession of generatrices;

said drum having two axially opposite end pieces which support between them two intercalated series of fabric pile-treating rollers for at least one of teaseling and fluffing the pile, said rollers being arranged along respective generatrices of said drum;

one said series of said rollers having a drive driving them for rotation in a first direction which corresponds to a direction of lay of said pile from said fabric, and the other said series of said rollers having a drive driving them for rotation in a second direction which is opposite to said direction of lay of said pile;

a motor-driven feed roller disposed adjacent said drum at a first location;

a motor-driven exit roller disposed adjacent said drum at a second location which is displaced angularly about said circumference of said drum from said first location, so that the fabric can be fed by contact with said feed roller into contact with said rollers of the said series, about a portion of the circumference of the drum and extracted by contact with said exit roller;

a plurality of cleaning brushes supported adjacent said circumference for cleaning engagement with rollers of said one and other series;

means defining at least one first aperture through at least one of said end pieces of said drum;

means defining at least one second aperture through at least one of said side pieces of said load-bearing structure;

each said first aperture being disposed in spacedly confronting relation to a respective said second aperture;

at least one suction unit having an inlet communicating through a respective said second aperture with a respective said first aperture, for collection by suction from within said drum fibers and dust generated by interaction of said fabric with said machine;

said cleaning brushes including:

a first cleaning brush arranged to be moved into serial cleaning engagement only with each of said rollers of said one series of fabric pile-treating rollers;

a second cleaning brush arranged to be moved into serial cleaning engagement only with each of said rollers of said other series of fabric pile-treating rollers;

a third cleaning brush arranged to be continuously disposed in cleaning engagement with said first cleaning brush; and a fourth cleaning brush arranged to be continuously disposed in cleaning engagement with said second cleaning brush.

4. The machine of claim 3, wherein:

each of said cleaning brushes extends horizontally, all parallel to one another, and is supported at a respective end thereof to a plate;

a pivot axle supporting said plate on one of said side pieces for reciprocating pivotal movement about a horizontal axis between a first position wherein said first brush is positioned for serial engagement with rollers of said one series and said second brush is spaced radially outwardly of said drum, and a second position wherein said second brush is positioned for serial engagement with rollers of said other series and said first brush is spaced radially outwardly of said drum; and an actuator engageable with said plate and operable for pivoting said plate on said pivot axle between said first and second positions.

* * * * *